United States Patent [19]

Schellenberg

[11] 4,088,242

[45] May 9, 1978

[54] THIN METAL FOIL MEMBRANE CAN CLOSURE HAVING AN EASY-OPEN SCORELINE

[75] Inventor: Walter Schellenberg, Diepoldsau, Switzerland

[73] Assignee: Max Sandherr AG, Switzerland

[21] Appl. No.: 760,324

[22] Filed: Jan. 18, 1977

[30] Foreign Application Priority Data

May 7, 1976 Switzerland ..... 5776/76

[51] Int. Cl.[2] ..... B65D 51/22

[52] U.S. Cl. ..... 220/258; 220/270

[58] Field of Search ..... 220/258, 266–273; 229/43

[56] References Cited

U.S. PATENT DOCUMENTS 3,314,569 4/1967 Seiferth et al. ..... 220/270

3,894,652 7/1975 Brown ..... 220/270

*Primary Examiner*—George T. Hall

*Attorney, Agent, or Firm*—Roylance, Abrams, Berdo & Kaul

[57] ABSTRACT

A pull-tab can closure of a thin metal foil membrane less than 0.15 mm. thick is provided with a peripheral scoreline for easy opening. The provision of a peripheral scoreline in a thin metal foil membrane is made possible by providing a flexible portion of the membrane parallel to and inside the radius of the scoreline. The flexible portion may be in the form of an inclined area relative to the scoreline or in the form of one or more concentric groove-like convex areas inside the radius of the scoreline. A method of making the closure and stamping means having a beveled score-forming edge are also disclosed.

9 Claims, 9 Drawing Figures

Fig. 1
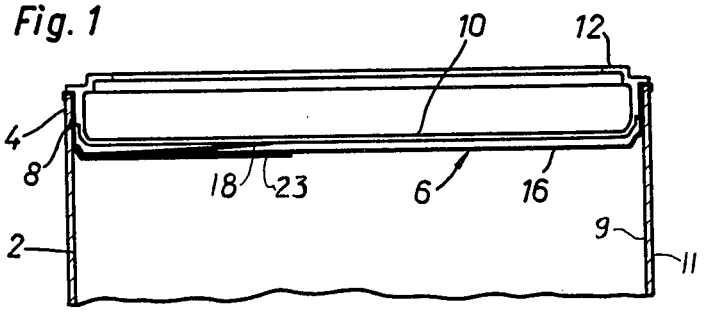
Fig. 2
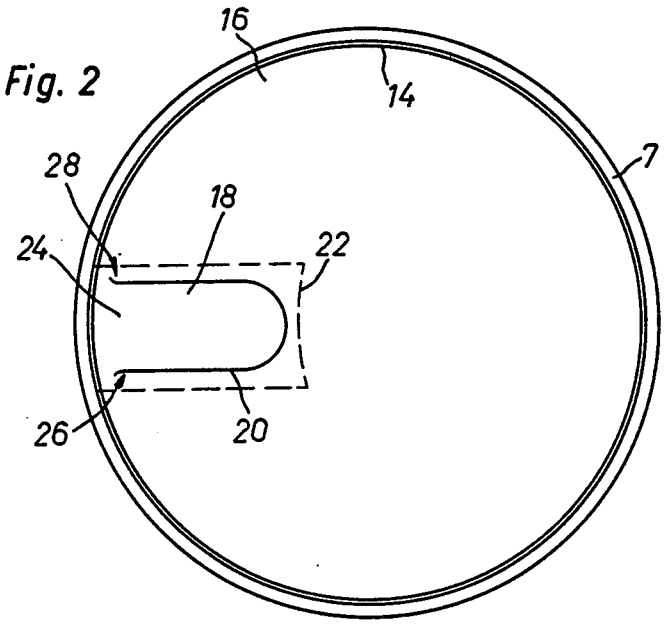
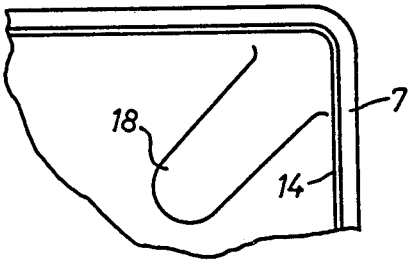
Fig. 3

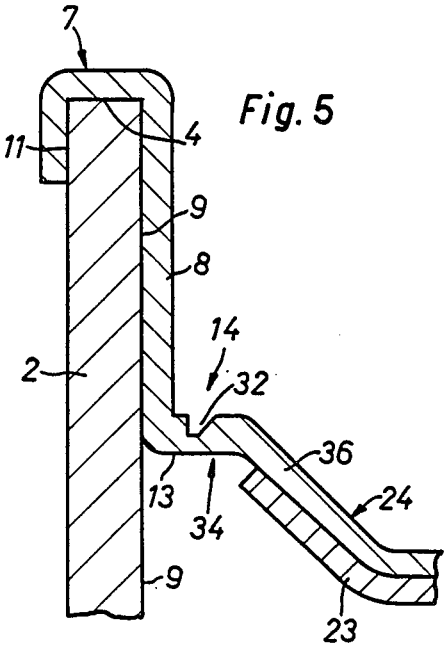
Fig. 5
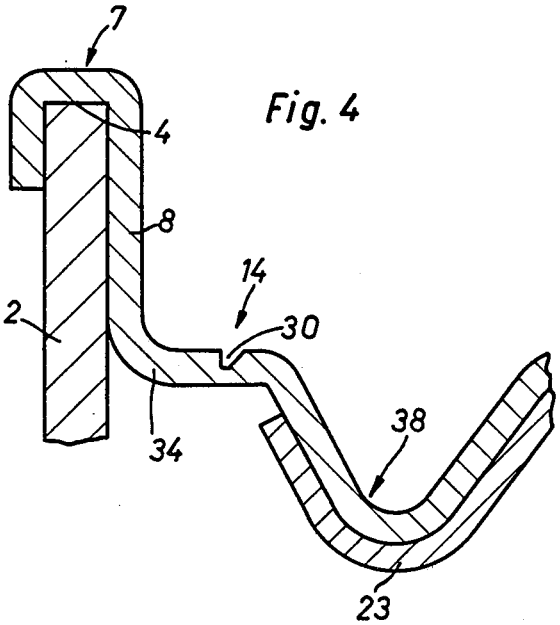
Fig. 4
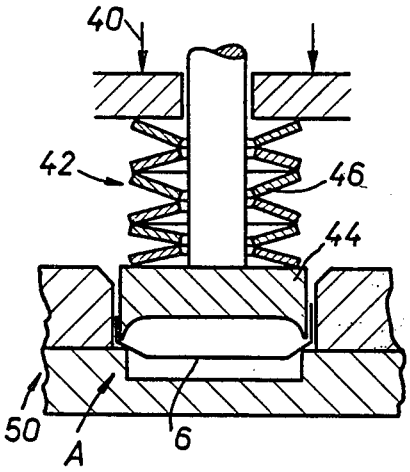
Fig. 6
Fig. 7
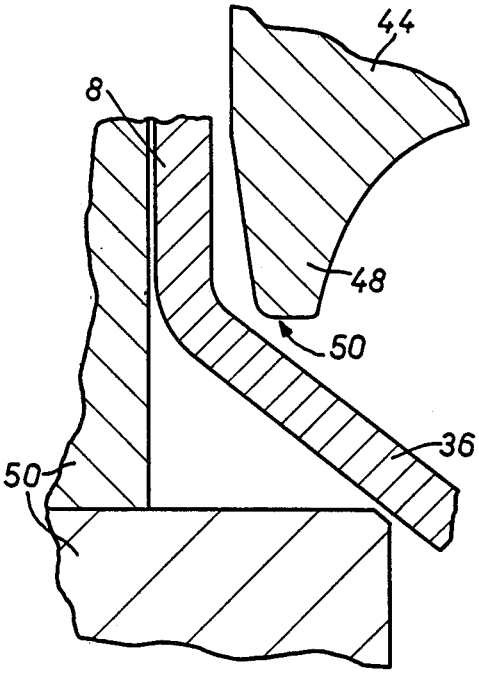

THIN METAL FOIL MEMBRANE CAN CLOSURE HAVING AN EASY-OPEN SCORELINE

The invention relates to a closure for a can with a metal membrane whose thickness is less than 0.15 mm which closes the can opening and has a pull-off tab, and also to a process for producing the can closure, as well as an apparatus for performing this process.

BACKGROUND OF THE INVENTION

According to known processes, the membrane serving as a guarantee seal is either produced by deep drawing with a cylindrical edge fixed directly to the inner wall of the can be sticking or heat-sealing (DAS 2,061,497) or the edge of the foil is stuck to a fastening ring made from sheet metal or plastic and enclosing the edge of the can, said ring serving as the edge protection on the can opening edge (German Pat. No. 1,814,951). According to this prior art, on opening the can the membrane is detached along the adhesive joint by pulling on a pull-off tab. These known can closures have the disadvantage of being costly and complicated to manufacture, and after opening the can, the edge thereof is irregular due to adhesive residue, and more particularly the inwardly projecting portion of the fastening ring is a hindrance on emptying the can.

In order to prevent, in the known construction with a cylindrical membrane edge, the destruction of the edge protection on the can opening formed by part of the membrane on tearing away the membrane, a separating cut is provided in the stuck can edge which extends both through the edge protection and through the inner lining of the can into the cardboard can body. Due to the limited precision, it is not possible to reliably make such a shallow cut with a cutting tool and in addition it is technically far from easy to make a cut on the inner wall of the can which runs in the peripheral direction of the can. An important disadvantage of this known can closure is also that on removing the membrane, part of the inner lining of the can is also usually torn away, so that the cardboard material comes into direct contact with the product contained in the can giving an unhygienic impression. When using a thicker foil material, i.e., sheet metal, in which according to the prior art (DAS 1,757,311) a groove is stamped therein without cutting the membrane, it is no longer possible to fix the membrane in the can through sticking due to the fact that the foil material is not easily deformable, so that such sheet metal closures can only be fixed to the can by flanging around the can edge. It is not possible in this way to fix metal foils with a thickness less than 150$\mu$ (0.15 mm.) because then the can edge can no longer be embraced in clamping manner by the flange or the clamping forces cannot be taken up by the thin foil material.

Furthermore, a can closure is known which has a closure membrane whose thickness is less than 150$\mu$ (0.15 mm.) and in which the desired separating line is located in a portion of the membrane which covers the can opening. In this case the membrane is already cut along the desired separating line by means of a punch and the cut line is covered by a thin foil stuck to the back of the membrane.

BRIEF DESCRIPTION OF THE INVENTION

An object of the present invention is to provide a can closure which avoids the aforementioned disadvantages of known can closures, which can be reliably manufactured at reasonable cost, and whose membrane can be opened in a particularly clean and simple manner.

Accordingly, a can closure of the type indicated hereinbefore is proposed which is characterized in that the desired separating line of the closure membrane is formed by a groovelike constriction of the membrane material, and wherein, parallel to the constriction, is provided a membrane area which is inclined relative to the membrane plane, whereby the diameter of said membrane area is smaller than the constriction passing round the same.

As is, for example, shown by the above-mentioned embodiment of a can closure with a precut desired separating line, it was not hitherto considered possible to provide thin closure membranes with a desired separating line or weakening line formed by a constriction. It has surprisingly been found that a construction of the can closure according to the invention is advantageously also possible in the case of a closure membrane whose thickness is only 50 to 60$\mu$ (0.050 to 0.060 mm.) without the thus weakened membrane, e.g., on fixing in the can opening fracturing due to the deformations occuring when transporting the can or due to the pressure of the can's content. The preferred thickness of the thin metal foil closure membrane is between about 50 to 80$\mu$ (0.050 and 0.080 mm.).

According to an advantageous embodiment of the can closure, that portion of the membrane remaining on the can body after opening the can can be passed over the edge of the can as an edge protection so that, simultaneously with the insertion of the membrane, the edge protection is also formed.

According to a further advantageous embodiment of the can closure, the constriction is connected to the cylindrical portion of the membrane fixed to the inner wall of the can and forms a narrow inwardly directed membrane shoulder. The positioning of the constriction at this transition point permits the closure portion of the membrane to be removed in a particularly simple manner by pulling upwards the pull-off tab provided on the membrane. Advantageously, the membrane portion connected to the narrow shoulder on the inside is inclined, or alternatively the membrane is provided with one or more groove-like convexities parallel to the weakening groove so that forces acting in the membrance plane can be compensated by deformation without fracturing the membrane.

The pull-off tab for removing the membrane on first opening the can can advantageously be arranged in such a way that it extends by its end secured to the membrane up to the narrow membrane shoulder and is located on a curved portion of the desired separating line. Since, due to the curvature of the desired separating line, the end of the pull-off tab is closest to the desired separating line at two facing points, there is a stress concentration at these points and it is here that the start of tearing away takes place so that the membrane can be removed particularly easily by pulling on the pull-off tab.

According to a further advantageous embodiment of the invention, the pull-off tab is stamped from the closure membrane and is therefore connected in one piece with the membrane, whereby the stamped out opening is sealed by a counter-struck foil portion. As compared with the known sticking of a pull-off tab to the membrane, this can closure construction leads to a saving in material and a more reliable fixing to the membrane which is necessary to facilitate tearing away through the above-mentioned stress concentration.

In place of a pull-off tab it is also possible to preform an opening tab in the membrane by stamping, which for tearing out the membrane by means of a finger can be pressed inwards into the can.

The weakening groove can be located both on the top and on the bottom of the membrane, but preference is given to the positioning on the top due to the easier construction of the tools.

The invention also proposes a process for producing the can closure which is characterized in that the constriction forming the desired separating line is produced by stamping in a press, whereby through the adjustment of the stamping force the constriction depth is limited. Furthermore, a stamping press for performing this process is proposed which is characterized in that the stamp die and/or stamp punch is spring-mounted so that the stamping force is adjustable through the variable deflection of the sprung portion of the stamping press.

According to an advantageous embodiment of the process, stamping of the constriction takes place in a portion of the membrane linked with the cylindrically preshaped membrane edge and which is directed conically inwardly, so that due to the stamping movement by the stamping tool taking place parallel to the cylindrical membrane portion, a narrow shoulder is shaped into the membrane, whereon follows the conical membrane portion in the direction of the center of the membrane.

In order that the manner in which the foregoing and other objects are attained in accordance with the invention can be understood in detail, particularly advantageous embodiments thereof will be described with reference to the accompanying drawings, which form a part of this specification, and wherein:

FIG. 1 is a partial side elevation, in section, schematically showing the upper part of a can having a closure membrane and a mounted press-in lid;

FIG. 2 is a plan view of the can of FIG. 1 with the lid removed;

FIG. 3 is a partial plan view of the top of a can having a rectangular opening;

FIGS. 4 and 5 are enlarged partial side elevations, in section, of the membrane in the area of the desired separating line and the pull-off tab;

FIG. 6 is a schematic side elevation, in section, of an apparatus for forming a closure according to FIGS. 5 and 6;

FIG. 7 is an enlarged partial side elevation, in section, of the apparatus of FIG. 6;

DETAILED DESCRIPTION OF THE INVENTION

Figure 8:
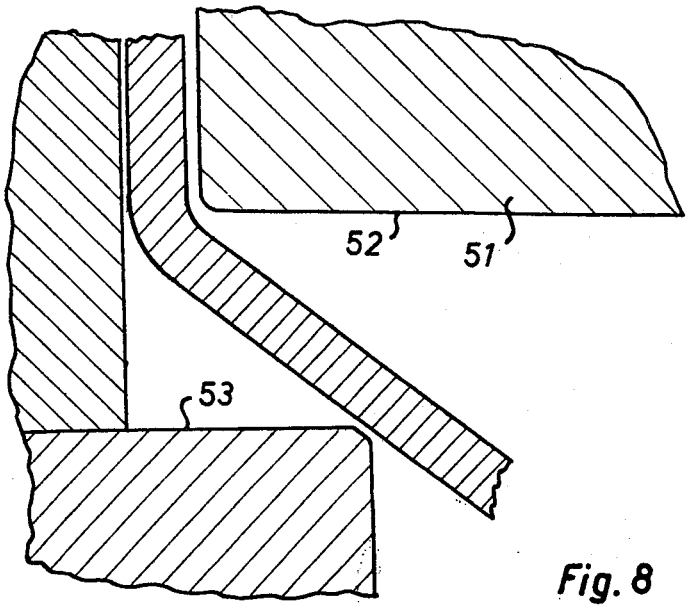
FIG. 8 is an enlarged side elevation of a further embodiment of an apparatus for forming a closure.

FIGS. 1 and 2 show side elevation and top views of a can with a cardboard can body 2 which can be cut from a cardboard tube, respectively, which is lined on either side by lining layers 9 and 11. The cut edge 4 on the side of the can opening is covered by the outer edge of the closure membrane 6 by passing the membrane outwardly over the can edge as an edge protection 7. In this area forming the edge protection and with its cylindrical part 8 engaging with the inner wall of the can, the membrane is firmly connected with the can body or its lining layers 9 and 11 by providing this side of the membrane with a lining layer 13 made from heat sealing wax and both layers are heat-sealed together. The lining layers can comprise, for example, a polyvinylchloride (PVC) lacquer. In the example shown, the cylindrical edge portion 8 of the closure membrane 6 is deep drawn to such an extent that a press-in lid 10 with an inner gripping edge 12 can be inserted for protecting the membrane and for sealing the can after removing the membrane. It is obvious that in place of the press-in lid 10, it is also possible to use a push-on lid so that the cylindrical edge portion is then correspondingly less deeply drawn.

A pull-off tab 18 which, in the example shown, is formed by stamping along line 20, is used for removing closure portion 16 of closure membrane 6 located within the surrounding desired separating line 14. By means of a foil portion 23 which is stuck to the bottom of the membrane and is indicated in FIG. 2 by dotted lines 22, the opening resulting from the stamping process is tightly sealed. The remaining end 24 of the pull-off tab 18 is connected with the membrane and extends to the vicinity of the desired separating line 14, and as the latter is curved, the facing points 26 and 28 of the tab end are closest to the desired separating line 14. On pulling the pull-off tab the tearing force is correspondingly concentrated at these points so that tearing open is facilitated. In the case of cans with a rectangular opening cross section, the pull-off tab is therefore advantageously positioned diagonally in one corner of the membrane, as shown in FIG. 3. Obviously, a pull-off tab can be fixed to the top of the membrane in some other manner, e.g., by sticking. In place of the pull-off tab an opening tab can be preformed in the membrane by stamping, e.g., in accordance with FIG. 3. For opening the can this tab is pressed in, so that by inserting a finger into the resulting opening, the membrane can be torn out upwards.

Figure 9:
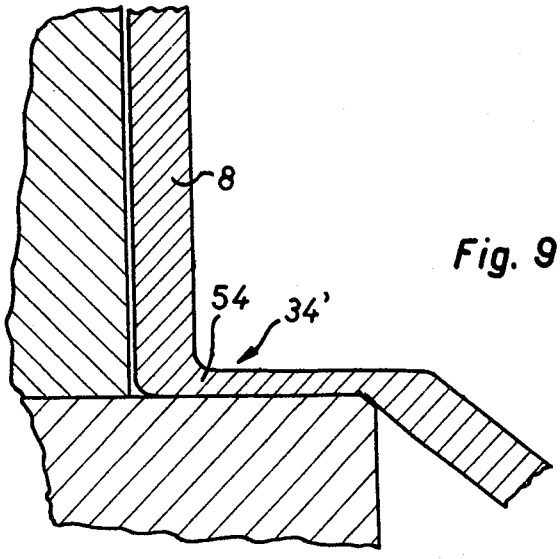
FIG. 9 is an enlarged partial side elevation of the membrane area shaped by the apparatus of FIG. 8.

The desired separating line 14 is formed by a groove-like constriction as shown at 30, 32 or 54 in FIGS. 4, 5 and 9, which is preferably parallel to the edge of the can, said groove being located in a portion of membrane 6 which is at right angles to the can wall. When the desired separating line 30 is arranged in accordance with FIG. 4 at a considerable distance from the can wall, resulting from the curved transition 34 to the cylindrical membrane portion 8, it is recommended that on opening the can, the membrane is firstly pressed downwards in the area of end 24 of pull-off tab 18 so that the desired separating line 14 tears at this point. The membrane can subsequently easily be removed in the upward direction by pulling on the pull-off tab.

In the embodiment of FIG. 5, the groove 32 is arranged in the immediate vicinity of the cylindrical membrane portion 8 on a narrow membrane shoulder 35 which extends inwardly into as inclined membrane portion 36. This arrangement facilitates the tearing away of the membrane because it is merely necessary to pull upwards the closure portion 16 on pull-off tab 18. The portion of the membrane remaining on the can and adjacent to the desired separating line 14 prevents the membrane from giving way due to its heat-sealed connection with the can body 2, and consequently the tearing open force is concentrated in the areas of the desired separating line. The shoulder 34 also prevents any danger of tearing along the desired separating line during the operation of fixing the membrane in the can opening. This embodiment has the further advantage that after removing the closure portion, a flat opening edge is obtained which reduces the danger of injury on the can opening and also ensures a clean emptying of the can contents. The membrane portion remaining on the can then forms, as indicated hereinbefore, the edge protection of the can. The inclined membrane portion 36 can also form part of a groove-like convex area 38 which is parallel to the weakening groove 32, and thus fulfills the function of compensating, by deformation, forces which unintentionally act on the membrane so that they cannot concentrate in the weakening groove. An example of such a groove-like convex area seam 38 is shown in FIG. 4. For the same purpose, the membrane can also be provided with a plurality of preferably concentric groove-like convex area seams 38.

In the example of FIG. 9, the cross-sectional thickness of the whole narrow shoulder 34' is reduced, thus forming a desired separating zone 54, which is directly adjacent to the cylindrical part 8 of the membrane.

For producing the can closure according to the invention, a stamping machine is used, for example, in accordance with the schematic representation of FIG. 6, in which the stamping pressure is transmitted to the stamp die 44 in the direction of the arrows 40 via a resilient deflectable apparatus part 42. The stamping force can be applied in conventional manner, e.g., by means of a crank or eccentric drive. The resilient apparatus part 42 comprises, for example, a set of cup springs 46. Through limiting the movement of stroke of the crank or eccentric drive and therefore the deflection of springs 46, it is possible to set the spring tension or stamping force with a relatively high precision, so that when stamping any significant excessive weakening of the membrane in the weakening groove is reliably prevented. To obtain a sufficiently large minimum force for producing the weakening groove 30 or 32, the stamping profile 48 of the stamping tool is beveled on its lower edge 40, whereby advantageously the bevel amounts to 0.2 to 1 mm. If the bevel is too small, i.e., the stamping edge is too sharp, there is a danger that the membrane will be cut through despite the stamping force being set to a lower level.

According to an advantageous embodiment of the process of the invention, the narrow shoulder 34 having the weakening groove 32 is produced by the stamp die 44, as shown in FIG. 7. To this end, a membrane deep-drawn in a previous operation is used, the membrane having an inwardly inclined portion 36 linked to the cylindrical portion 8. As a result, during stamping it is shaped into the narrow shoulder 34 shown in FIG. 5 by the stamping force and the opposing force of the die in its upper part. The prior shaping of such a narrow shoulder 34 which is only, for example, 1 mm wide, by deep drawing would take place at the high pressures conventional in deep drawing processes in order to obtain a regular shape. However, at the edges of the shaping tool these pressures lead to an undesired and uncontrolled stamping of the membrane so that leaks in the membrane and an irregular tear line would be possible.

In the case of a membrane with a diameter of 76 mm, the stamping pressure for producing the weakening groove is, for example, two to three metric tons when the bevel of the stamping edge is 0.2 to 0.3 mm.

In the construction of the stamping machine according to FIG. 8, the stamp die 51 is provided with a flat stamping surface 52, which cooperates with the narrow shoulder 53 on the die cavity in such a way that on shaping the narrow shoulder 34' of the membrane, said shoulder is compressed to such an extent that a desired separating zone 54 is formed. The width of this shoulder can advantageously be less than 0.5 mm.

As stated hereinbefore, the weakening groove can also be provided on the bottom of the membrane, for which purpose a stamping profile 48' would be correspondingly provided on punch 50. To provide further security against membrane gas leaks due to porosity, the membrane, particularly in the area of the desired separating line can be coated with a lacquer, e.g., vinyl lacquer which must be as brittle as possible so that it breaks easily on tearing away the membrane.

While certain advantageous embodiments have been chosen to illustrate the invention, it will be understood by those skilled in the art that various changes and modifications can be made therein without departing from the scope of the invention as defined in the appended claims.

What is claimed is:

1. A can closure comprising a thin metal foil membrane extending across and sealing the can opening in a plane parallel to the can end, said membrane having a thickness of between about .050 and 0.10 mm. and having a pull-off tab thereon;

means in said membrane defining a desired separating line, said means including a groove-like constriction of diminished thickness, said membrane including an area extending generally parallel to said constriction and inclined relative to the plane of said membrane, the diameter of said inclined area being smaller than the diameter of said constriction; and a removable protective lid extending across said can opening outwardly of said thin metal foil membrane.

2. A closure according to claim 1 wherein the peripheral portion of said membrane remaining on the can body after separating said membrane along said line is formed as an edge protection portion for the edge of the open end of said can.

3. A closure according to claim 2 wherein said edge protection portion includes a cylindrical portion affixed to the inner surface of the can and wherein said constriction lies radially inwardly of said cylindrical portion defining a narrow inwardly extending membrane shoulder to remain after separation.

4. A closure according to claim 1 wherein said inclined area is part of at least one groove-like convex area in said membrane.

5. A closure according to claim 1 wherein said pull-off tab on said membrane extends radially inwardly from a location adjacent to and closely spaced from said constriction.

6. A closure according to claim 5 wherein one end of said tab is firmly attached to said membrane at said location adjacent said constriction, and wherein said constriction is curvilinear adjacent said location.

7. A closure according to claim 5 wherein said tab is integral with said membrane and is formed therein by stamping a cut in said membrane, said closure further comprising a foil member adhered to the membrane to cover and seal said cut.

8. A closure according to claim 1 wherein said groove-like constriction is beveled.

9. A closure according to claim 1 wherein said tab is integral with said membrane, said tab being preformed by stamping a weakening line in said membrane corresponding to the outline of said tab, wherein the edges defining said tab extend radially inwardly from a location adjacent to and closely spaced from a curvilinear portion of said constriction, said pull tab being fixed to the membrane over its entire width between said edges at said point adjacent said constriction, and said closure further comprising a foil member adhered to the membrane to fully lap said tab portion of the membrane.

* * * * *